343-700 MS AU 256 EX
2/14/78 OR 4,074,270

United States Patent [19]

Kaloi

[11] 4,074,270

[45] Feb. 14, 1978

[54] MULTIPLE FREQUENCY MICROSTRIP ANTENNA ASSEMBLY

[75] Inventor: Cyril M. Kaloi, Thousand Oaks, Calif.

[73] Assignee: The United States of America as represented by the Secretary of the Navy, Washington, D.C.

[21] Appl. No.: 712,994

[22] Filed: Aug. 9, 1976

[51] Int. Cl.[2] ..... H01Q 1/38

[52] U.S. Cl. ..... 343/700 MS; 343/853; 343/885

[58] Field of Search ..... 343/846, 853, 885, 700 MS, 343/745

[56] References Cited

U.S. PATENT DOCUMENTS

| | | | |
|---|---|---|---|
| 3,541,559 | 11/1970 | Evans | 343/795 |
| 3,680,136 | 7/1972 | Collings | 343/700 MS |
| 3,811,128 | 5/1974 | Munson | 343/700 MS |
| 3,971,032 | 7/1976 | Munson et al. | 343/700 MS |

*Primary Examiner*—Eli Lieberman

*Attorney, Agent, or Firm*—Richard S. Sciascia; Joseph M. St.Amand

[57] ABSTRACT

A very thin antenna assembly consisting of three electric microstrip antenna systems arrayed on a single dielectric substrate over a ground plane and tuned to three different frequency bands. The low physical profile of the antennas and the assembly hollow conformal arraying capability about an aircraft body without disrupting the aerodynamics of the vehicle. A phase difference of 90° between two elements of the UHF antenna system is used to obtain a wider bandwidth with good matching and also improves the radiation patterns of the array. Button type tuning capacitors in each of the elements of the UHF array permits compensation for variations in the center frequency of the UHF antenna system that are caused by the variation in the substrate dielectric constant, fabrication processes, etc. Also, close spacing of three antennas systems with minimum coupling is possible since most of the reactive energy from each antenna element is contained substantially within the volume bounded by the element and the portion of the ground plane beneath the element.

24 Claims, 15 Drawing Figures

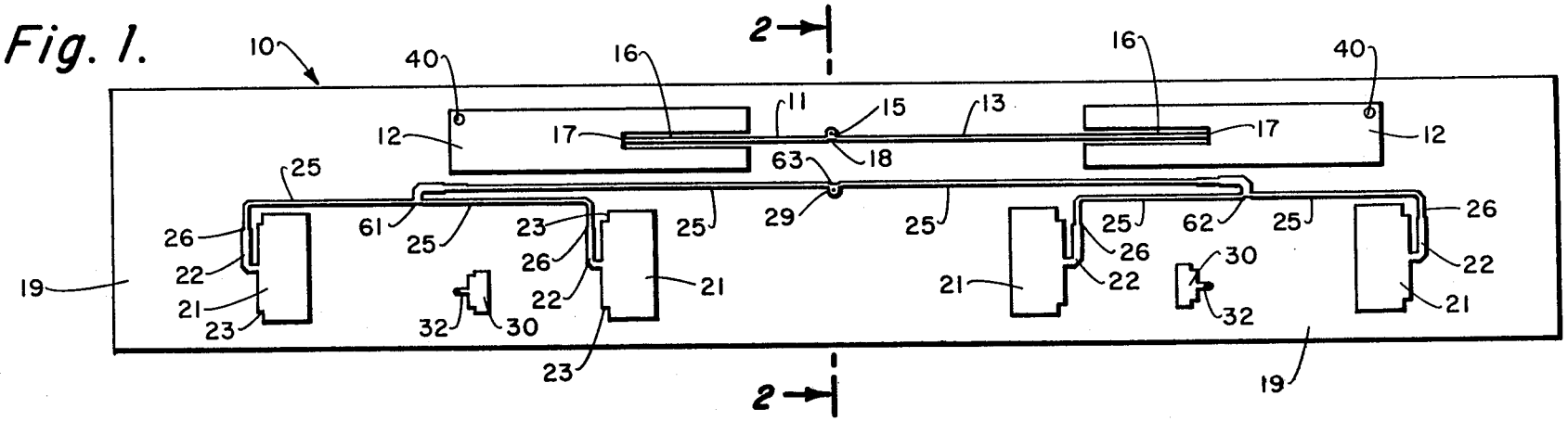
Fig. 1.
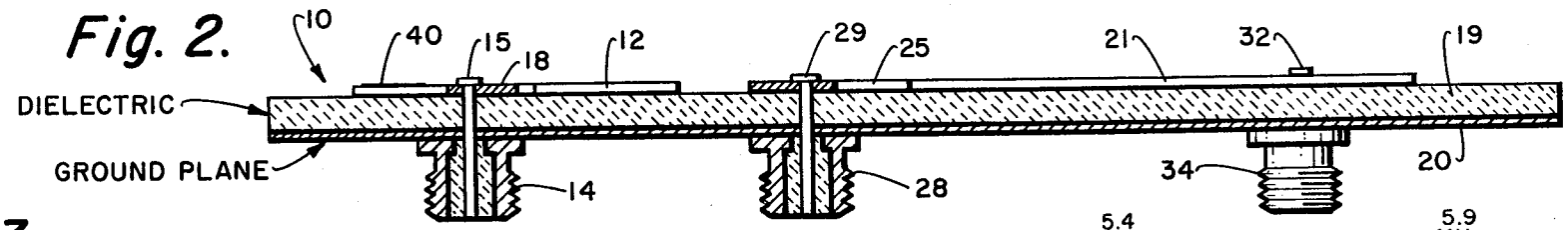
Fig. 2.
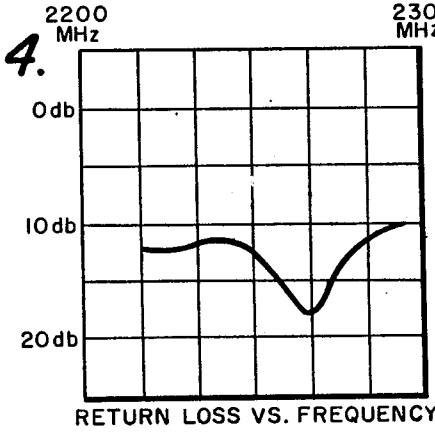
Fig. 3.
Fig. 4.
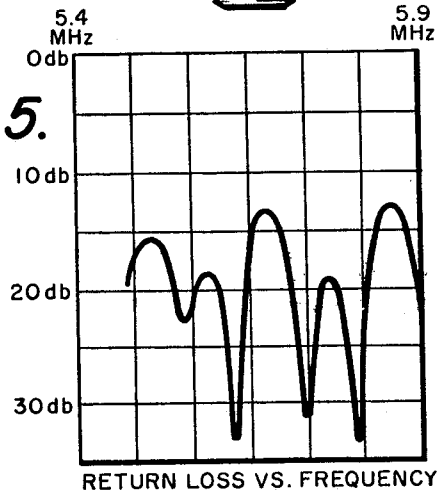
Fig. 5.

Fig. 11.

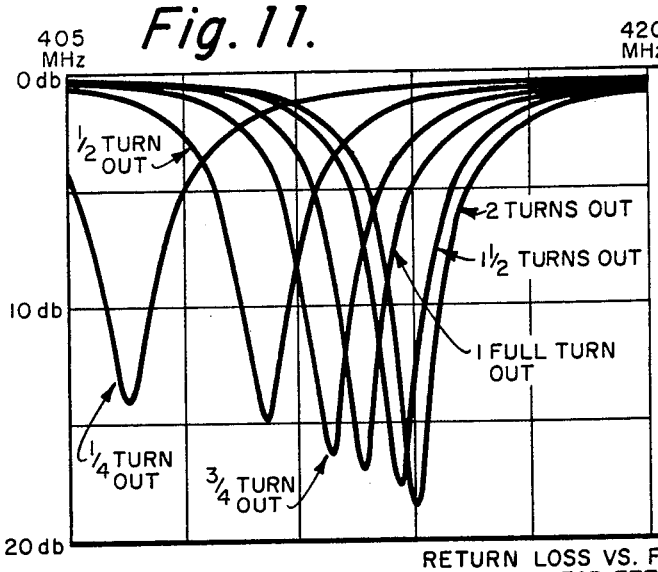

| SLUG TURNS OUT | CENTER FREQUENCY MHz |
|---|---|
| 1/4 | 406. 64 |
| 1/2 | 410. 10 |
| 3/4 | 411. 83 |
| 1 | 412. 75 |
| 1 1/2 | 413. 60 |
| 2 | 413. 98 |

DISTANCE BETWEEN SLUG AND ELEMENT/CAP FOR EACH 1/4 TURN = 0.0046 INCH

RETURN LOSS VS. FREQUENCY
(CAPACITOR NEAR FEEDPOINT END)

Fig. 12.

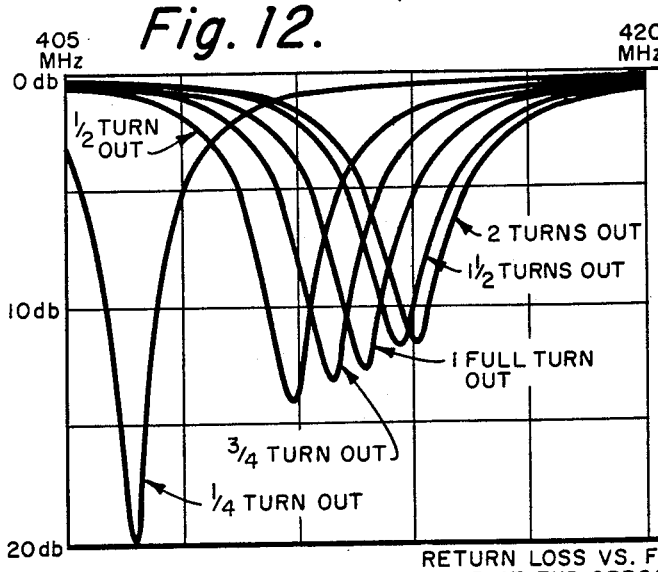

| SLUG TURNS OUT | CENTER FREQUENCY MHz |
|---|---|
| 1/4 | 406.67 |
| 1/2 | 410. 84 |
| 3/4 | 411. 93 |
| 1 | 412. 79 |
| 1 1/2 | 413. 66 |
| 2 | 414. 08 |

DISTANCE BETWEEN SLUG AND ELEMENT/CAP FOR EACH 1/4 TURN = 0.0046 INCH

RETURN LOSS VS. FREQUENCY
(CAPACITOR AT END OPPOSITE FEEDPOINT)

Fig. 14.

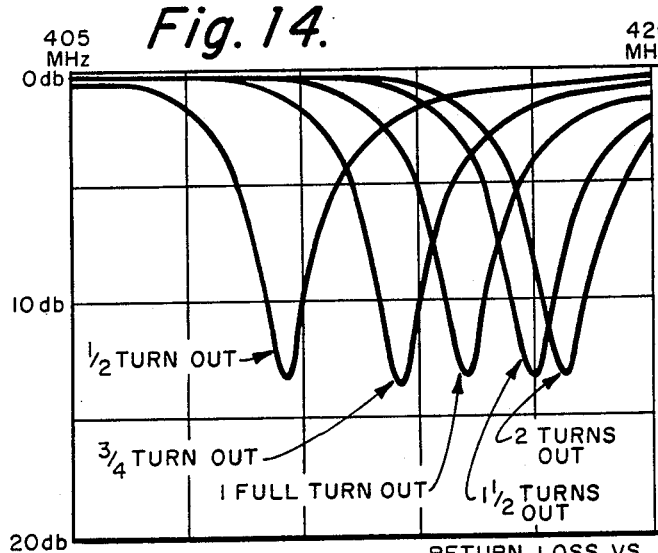

| SLUG TURNS OUT | CENTER FREQUENCY MHz |
|---|---|
| 1/2 | 410. 66 |
| 3/4 | 413. 58 |
| 1 | 415. 30 |
| 1 1/2 | 417. 15 |
| 2 | 417. 92 |

DISTANCE BETWEEN SLUG AND ELEMENT/CAP FOR EACH 1/4 TURN = 0.0046 INCH

RETURN LOSS VS. FREQUENCY
(CAPACITORS BOTH NEAR AND OPPOSITE TO FEEDPOINT TUNED THE SAME)

MULTIPLE FREQUENCY MICROSTRIP ANTENNA ASSEMBLY

This invention is related to copending U.S. Patent applications:

Ser. No. 571,154 for DIAGONALLY FED ELECTRIC MICROSTRIP DIPOLE ANTENNA, now U.S. Pat. No. 3,984,834;

Ser. No. 571,156 for END FED ELECTRIC MICROSTRIP QUADRUPOLE ANTENNA, now U.S. Pat. No. 3,972,050;

Ser. No. 571,155 for COUPLED FED ELECTRIC MICROSTRIP DIPOLE ANTENNA, now U.S. Pat. No. 3,978,487;

Ser. No. 571,152 for CORNER FED ELECTRIC MICROSTRIP DIPOLE ANTENNA;

Ser. No. 571,157 for OFFSET FED ELECTRIC MICROSTRIP DIPOLE ANTENNA, now U.S. Pat. No. 3,978,488;

Ser. No. 571,158 for ASYMMETRICALLY FED ELECTRIC MICROSTRIP DIPOLE ANTENNA, now U.S. Pat. No. 3,972,049; and to U.S. Pat. No. 3,947,850 for NOTCH FED ELECTRIC MICROSTRIP DIPOLE ANTENNA;

all filed together on Apr. 24, 1975 by Cyril M. Kaloi.

BACKGROUND OF THE INVENTION

This invention relates to low physical profile antennas and particularly to an assembly of electric microstrip antennas and antenna systems that can be arrayed on a single substrate and tuned to several different frequency bands. Various electric microstrip antennas of the type aforementioned can be used in the present type antenna assembly.

SUMMARY OF THE INVENTION

The antenna assembly consists of three electric microstrip antenna systems tuned to three different frequency bands. These are, for example, a beacon C-band antenna system (5400 MHz - 5900 MHz), a telemetry S-band antenna system (2200 MHz - 2290 MHz) and a flight termination UHF antenna system (425 ± 1.5 MHz).

The several antenna systems elements and the feed lines can be photo-etched simultaneously. Each dielectric microstrip antenna consists essentially of a conducting strip called the radiating element and a conducting ground plane separated by a dielectric substrate. The length of each radiating element is approximately one-half wavelength. The width may be varied depending on the desired electrical characteristics for the elements. The conducting ground plane is usually much greater in length and width than the area of the radiating elements.

The thickness of the dielectric substrate should be much less than one-fourth the wavelength.

The multiple antenna assembly hereinafter described can be used in missiles, aircraft and other type applications where a low physical profile antenna is desired. This structure provides an antenna assembly with ruggedness, simplicity, low cost, a low physical profile, and conformal arraying capability about the body of a missile or vehicle where used including irregular surfaces, while giving excellent radiation coverage. The antenna assembly can be arrayed over an exterior surface without protruding, and be thin enough not to affect the airfoil or body design of the vehicle. The thickness can be held to an extreme minimum depending upon the bandwidth requirements. Due to its conformability, this antenna assembly can be applied readily as a wrap around band to a missile body without the need for injuring the body and without interfering with the aerodynamic design of the missile.

The antenna assembly of this invention can be fed very easily from the ground plane side.

New features in this multiple frequency antenna assembly involve several innovations: (1) the use of a 90° phase difference between elements of an array for obtaining wider bandwidth, (2) the use of an element which includes within its substrate a button type tuning capacitor to provide compensation for variations in the center frequency of the antenna system that are caused by the variation in the substrate dielectric constant, etc., and (3) the close spacing of a plurality of different microstrip antenna systems at different frequencies on a single substrate with a minimum of coupling between each antenna system.

BRIEF DESCRIPTION OF THE DRAWINGS

FIG. 1 is a schematic diagram of a preferred embodiment for an antenna assembly using three electric microstrip antenna systems.

FIG. 2 shows an enlarged cross-sectional view of the antenna assembly embodiment of FIG. 1 taken along line 2—2.

FIG. 3 is a typical plot showing return loss versus frequency for the UHF-band antenna system of the assembly such as shown in the embodiment of FIG. 1.

FIG. 4 is a typical plot showing return loss versus frequency for the S-band antenna system of the assembly such as shown in the embodiment of FIG. 1.

FIG. 5 is a typical plot showing return loss versus frequency for the C-band antenna system of the assembly such as shown in the embodiment of FIG. 1.

FIG. 11 shows a typical plot of return loss versus frequency for various penetration of the button type tuning capacitor slug of FIGS. 7 and 8 located at the end of an element near the feed point.

FIG. 12 shows a plot similar to that in FIG. 11 for an element having a button type tuning capacitor located on the far end of the element from the feed point.

FIG. 14 shows a plot like in FIGS. 11 and 12 for a single element having a button type tuning capacitor on each of its ends as shown in FIG. 13, both capacitors tuned the same.

DESCRIPTION OF THE INVENTION

Figure 6:
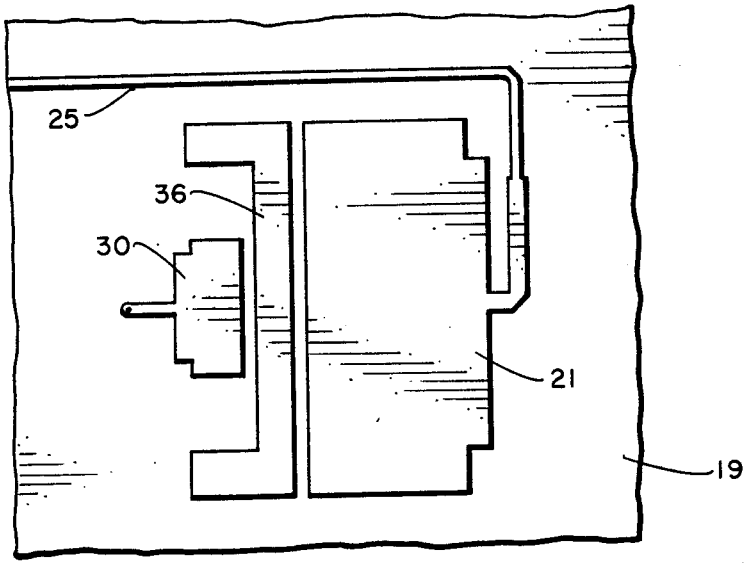
FIG. 6 is a schematic diagram showing an etched shield between two different antennas.

The antenna assembly 10, shown in FIG. 1, consists of three electric microstrip antenna systems tuned to three different frequency bands; a beacon C-band, a telemetry S-band, and a flight termination UHF band, for example. The schematic diagram of FIG. 1 shows the antenna assembly 10, of the present invention when laid out in the flat. Various numbers of antenna systems can be arrayed and assembled in close arrangement using the techniques of this invention.

The UHF Band Antenna System, shown by way of example, is a two-element array system (more than two can be used if desired). The elements 12 are interconnected by microstrip transmission lines 11 and 13 to microstrip-to-coaxial adapter 14 at feed point 15, shown in FIG. 2. Transmission lines 11 and 13 are of different lengths for phase difference purposes, as will be explained later. The elements 12 and the interconnecting transmission lines 11 and 13 can be photo etched at the same time, as are the other elements in the antenna assembly. The dimensions and values given herein are merely by way of example and may be varied.

Elements 12 used for the UHF system are Notch Fed type elements of the type disclosed in aforementioned U.S. Pat. No. 3,947,850. The length of the notch 16 for the example used herein is cut approximately 3.9 inches into the element. At this point (i.e., feed point 17), the element presents an input impedance of approximately 100 ohms. The microstrip transmission lines 11 and 13 interconnecting the two UHF elements have a characteristic impedance of 100 ohms. These two 100 ohm lines merge into a 50 ohm line at 18 and here at feedpoint 15 the 50 ohm line interconnects to the microstrip-to-coaxial adapter 14, as shown in FIG. 2. The end view of the antenna assembly 10, shown in FIG. 2, shows microstrip-to-coaxial adapters on the opposite side of the substrate 19 and ground plane 20 from the antenna radiating elements.

In the example shown in FIG. 1, the length of the UHF element 12 is approximately 9.1 inches and the width is 2.0 inches. The feed end of one element 12 is approximately 2.5 inches from feed point 15 while the other element 12 is spaced approximately 7.6 inches from feed point 15; this difference in spacing, which is a one-fourth wavelength difference, gives a 90° phase difference beteen the two elements.

The S-band antenna system uses, for example, four End Fed Microstrip Quadrupole antenna elements of the type disclosed in aforementioned U.S. patent application, Ser. No. 571,156. These elements are shown arrayed in phase with one another. However, these elements can be phased in quadrature (90° phase difference between each adjacent element), if desired, as is explained later. The End Fed Quadrupole elements 21 have a high input impedance, therefore, a matching network is required to match to most practical impedances. Matching network for the antenna elements can make use of microstrip transmission line sections, and in the case of the end fed elements 21, microstrip transmission line sections 22 can be used in conjunction with trimming corners 23 of the elements to provide the proper response, i.e., frequency, input resistance, bandwidth, etc. Standard arraying techniques using microstrip lines 25 are used from feed points 26 to the microstrip-to-coaxial adapter 28 at point 29. Stagger tuning of the orthogonal oscillating modes within each element, as described in aforementioned U.S. patent application, Ser. No. 571,156, is used in the S-band system for optimizing matching over a wider frequency band.

The C-band antenna system shown in FIG. 1 also uses End Fed Microstrip Quadrupole type elements. In this case, microstrip interconnecting transmission lines are not used because of the desire to minimize the losses incurred over the length of transmission lines. Instead, low loss coaxial cables are used to feed the elements 30 at feed points 32 via microstrip-to-coaxial adapters 34. Stripline and/or microstrip transmission lines can be used, however, in some systems instead of coaxial cables where higher line losses are tolerable. In such instances, the interconnecting transmission lines can be photo etched along with the other elements.

FIG. 3, FIG. 4, and FIG. 5 show typical plots of return loss versus frequency for the UHF band and the S-band and the C-band antenna systems, respectively, of an assembly such as shown in FIG. 1.

The minimum coupling from one antenna system to another antenna system is made possible because most of the reactive energy is contained within the volume bounded by an element and ground plane portion directly under the element. Fringing effects are very minimal. The containment of the reactive energy between each element and that portion of the ground plane under the element also reduces skin currents. This allows more than one antenna system to be fitted into a relatively small spacing.

An etched shield 36 may be provided between antenna elements of different systems, such as when a C-band antenna element 30 is placed close to an S-band antenna element 21, as shown in FIG. 6. The shield 36 appears to act as a mode suppressor; however, the exact mechanism of its operation is not understood. If the shield is grounded to the ground plane, it operates better. When shield 36 is grounded, the overall length of the shield need only be somewhat greater than the S-band element width. When the shield is not grounded, the shielding effectiveness appears to be a function of the length of the shield. For the ungrounded case, the exact length must be determined experimentally, since it is also possible to enhance coupling between antenna elements for other lengths.

Figure 7:
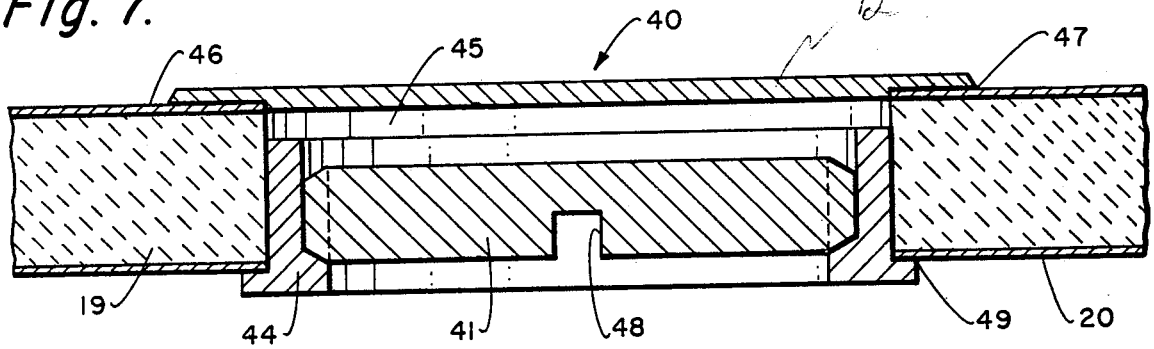
FIG. 7 is a cross-sectional view of one embodiment of a button tuning capacitor located within the microstrip dielectric substrate for an antenna element.

The use of a button-like capacitor 40 at a corner of elements 12, for example, as shown in FIG. 1, enables the antenna elements to be tuned over a small range of frequencies (a range, for example, of approximately ±1.5 MHz). Such tuning range is sufficient to allow for variations in the material properties or the fabrication process of an antenna or the assembly. Button capacitor 40 can usually be positioned anywhere along the end edge of the element. FIG. 7 shows a schematic of the button-like capacitor assembly in cross-section. The capacitor consists of a button-like tuning slug 41, a cap 42 and a flanged grommet 44, all made from brass or other suitable metal. As shown in FIG. 7, a circular aperture 45 is formed in the lamination which consists of dielectric substrate 19, ground plane 20 and the conducting strip 46. Cap 42 is mounted over aperture 45 and soldered at its outer edge 47 to make good electrical contact with the conducting strip 46 which is later etched in the form of the desired radiating element. Tuning slug 41 having a slot 48 is adjustably held by flanged grommet 44 and mounted in aperture 45 at the opposite side of substrate 19 from cap 42. The outer grommet flange is soldered at 49 to the ground plane 20 to provide good electrical contact. Slot 48 in slug 41 permits it to be adjusted within grommet 44, which may be threaded on the inside surface, by means of a screw driver or similar tool for fine tuning. Cap 42 operates to replace that portion of the element or conducting strip 46 removed in making aperture 45 through the laminae.

Figure 8:
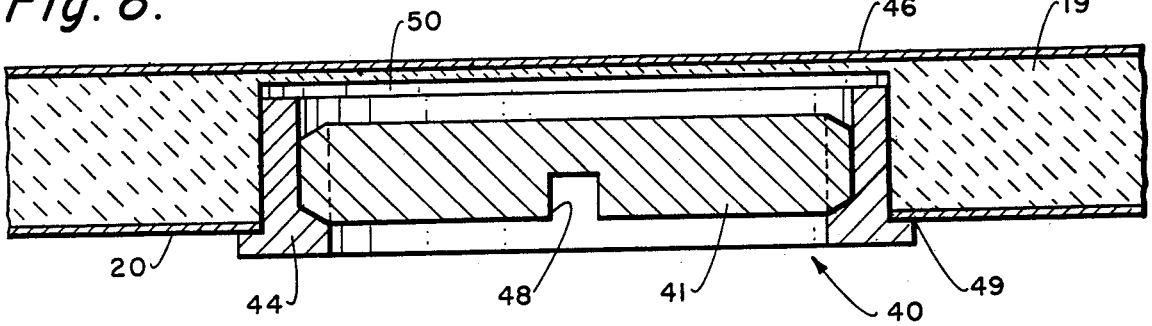
FIG. 8 is a cross-sectional view of another embodiment of a microstrip antenna element with a built-in button type tuning capacitor.
Figure 9:
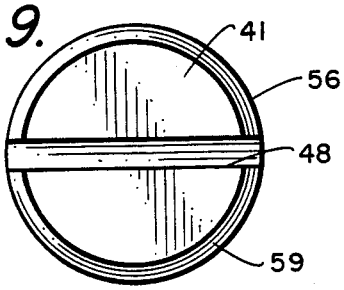
FIG. 9 shows a plane view of the button shaped tuning slug shown in FIGS. 7 and 8.
Figure 10:
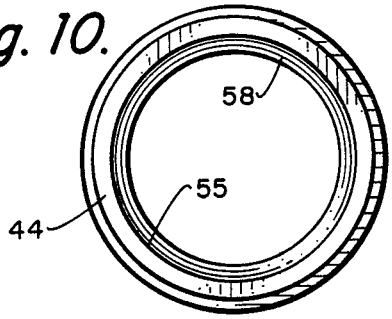
FIG. 10 is a plane view of the retaining grommet for button tuning slug shown in FIGS. 7 and 8.

The assembly shown in FIG. 7 may be preferable for manufacturing purposes; however, if desired, cap 42 can be eliminated in an assembly as shown in FIG. 8 where a shallow cylindrical cavity 50 is machined through ground plane 20 and into one side of dielectric substrate 19 opposite to the radiating element 46. Tuning slug 41 and grommet 44 are mounted in cavity 50, as shown in FIG. 8, and operate in the same manner as those shown in FIG. 7. A planar view of button tuning slug 41 and grommet 44 are shown in FIGS. 9 and 10, respectively. The inside surface 55 of grommet 44, as already mentioned, may be threaded to accommodate threads on the outer edge 56 of slug 41 for adjusting the capacitor toward or away from the antenna element or cap. Inner flange 58 of grommet 44 prevents the button tuning slug 41 from being removed. The edges of slug 41 can be tapered as shown at 59, if desired.

Increased penetration of the tuning slug 41 increases the capacitance from antenna element 46 to ground and conversely decreasing the penetration of the slug decreases the capacitance from the antenna element to ground.

The change of capacitance from the element to ground affects the resonant frequency and also the resonant input resistance of the antenna element.

Increased capacitance from the radiating element to ground lowers the resonant frequency of the antenna and conversely decrease capacitance from element to ground increases the resonant frequency of the antenna element. The capacitor assembly should be located at an end of the element, such as shown in FIG. 1, where the electric field concentration is higher and will cause a greater change in capacitance for a smaller penetration depth.

The effect of the capacitance on the resonant input resistance depends on which end of the element the capacitor is located. Locating the capacitor along the width of the element has no effect on the resonant frequencies and resonant input resistance. However, moving the location of the capacitor along the length of the element will vary the resonant frequencies and resonant input resistance with the effect being minimum at the center and the greatest effect being when the capacitor is located at either end.

If the capacitor assembly is located at the end opposite to the feed point, as in FIG. 1, increase in capacitance tends to increase the resonant resistance and conversely decrease in capacitance tends to decrease the resonant resistance.

If the capacitor assembly is located on the same end of the element as the feed point, an increase in capacitance tends to decrease the input resonant resistance and conversely a decrease in capacitance tends to increase the input resonant resistance.

The effect of increased capacitance on either end of the element is to increase the effective length of the element. As one can deduce, this affects the effective feed point location on the element. It has been shown in aforementioned copending U.S. patent application Ser. No. 571,158 and U.S. Pat. No. 3,947,850 that as the feed point is located towards the center of the element, the resonant input resistance approaches zero, whereas if the feed point is located towards the ends the resonant input resistance approaches a high value.

FIG. 11 shows a plot of return loss versus frequency for various penetrations of the capacitor slug and with the capacitor assembly on the end of the element near the feed point such as shown in FIG. 1. FIG. 12 shows a similar plot but with the capacitor assembly on the opposite end of the element from the feed point. The input resonant resistance for the element used in making measurements for FIG. 11 is approximately 33 ohms at 406.6 MHz and 39 ohms at 414 MHz. The input resonant resistance for the element used in making measurements for FIG. 12 is approximately 41 ohms at 406.6 MHz and approximately 29 ohms at 416 MHz. As one can observe the results shown in FIGS. 11 and 12 are in good agreement with the theory regarding the earlier mentioned Notch Fed and Asymmetrically Fed antennas. This variation of the resonant input resistance when capacitor tuning the antenna element may be undesirable in some instances since it limits the tuning range of the antenna element. Data included with the curves show center frequency at various distances of slug 41 from the element 46 or cap 42. Each one-fourth turn of the slug moves it a distance of 0.0046 inch. Slug 41 and grommet 44 can be threaded, as desired, for different distances per one-fourth turn of the slug.

Figure 13:
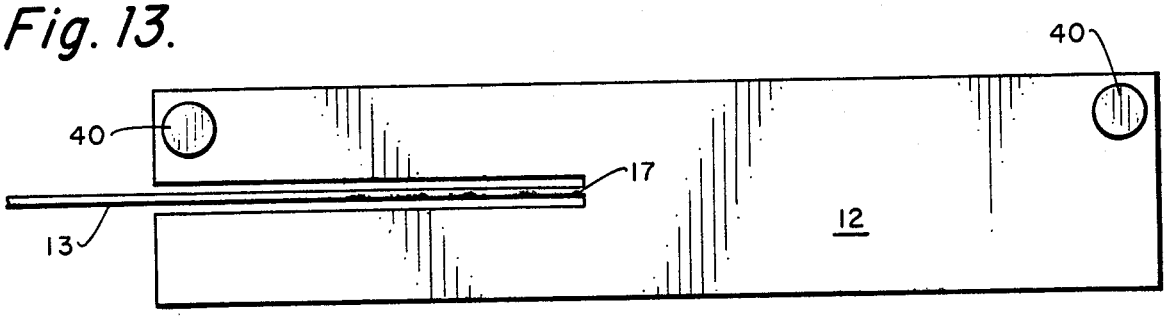
FIG. 13 shows a single notch antenna element having two button type tuning capacitors, one at each end.

It has been found when two button like capacitors are used on a single element, one on each end of the element, as shown in FIG. 13, for example, a compensating effect is observed, where minimum change in resonant resistance takes place when both button capacitors are turned in or out simultaneously. Where two button capacitors are used, one at each end, the capacitors may be positioned any place along the edge of the end of the element where they are located. FIG. 14 shows return losses versus frequency for two button capacitors on a single element as shown in FIG. 13. Note the almost constant input return loss. The input resistance is also found to be near constant. Two capacitors on one element also gives a wider tuning range than when using one capacitor. By adding a capacitance at each end of the element the tuning range is increased more than double the range when only a single capacitance is used.

One of the main advantages of having a 90° phase difference between two elements as opposed to having no phase difference, is the wider bandwidth. This occurs for the case of a one button capacitor in either end of the length of a single element and also for the case of using two button capacitors placed one in each end of the length of a single element. The 90° phase difference may be accomplished by adding a quarter-wave transmission line section in series with one of the elements. For the "multiple frequency assembly", where microstrip transmission lines are used to interconnect (parallel) the elements, it is only necessary to have the transmission line to one element a quarter-wave length longer than the transmission line to the other element, such as line 13 in FIG. 1.

The quarter-wave section functions as an impedance transformer, or in essence an impedance inverter. Whatever the input impedance into the element may be, the inverse impedance will appear at one end of the quarter-wave section when attaching the other end of the quarter-wave section to the element. If the input impedance into the element consists of a resistance $R_e$ in series with an inductive reactance $X_{1e}$, the input impedance into the other end of the quarter-wave section is given by a resistance R in parallel with a capacitive reactance $X_c$, where $$R = R_o^2/R_e$$

and $$X_c = R_o^2/X_{1e}$$

with $R_o$, the characteristic resistance of the quarter-wave section.

Table I shows a tabulation of the electrical input characteristics of a typical Notch Fed Electric Microstrip antenna. This antenna was designed to resonate at approximately 421.25 MHz with an input resistance normalized to 100 ohms. Table II shows the electrical input characteristics for the antenna used for Table I in parallel with a similar antenna and with a combined parallel input impedance normalized to 50 ohms. As can be deduced, the bandwidth characteristics of the parallel combination shown in Table II is essentially the same as the single element case shown in Table I.

Table III shows the input impedance of a two element array in parallel but having a 90° phase difference between the two elements. The elements are the same as the element used for Table I, however, one of the elements has a quarter-wave transmission line section in series prior to making a parallel connection as shown for element 12 in FIG. 1. As can be observed, the bandwidth of the antenna system with the 90° phase difference is much better than the antenna system without the 90° phase difference. A plot of points $P_1$ through $P_8$ from Table III is shown as curve B in FIG. 15.

Table I

NOTCHED ANTENNA INPUT IMPEDANCE CHARACTERISTICS (Single Element)

| Points | FREQ (MHz) | Zin (ohms) | Zin (ohms) Normalized to 100Ω | VSWR |
|---|---|---|---|---|
| $P_1$ | 419 | 10 + 533 | 0.1 + 50.33 | 11:1 |
| $P_2$ | 420 | 20 + 540 | 0.2 + 50.4 | 5.8:1 |
| $P_3$ | 420.5 | 40 + 550 | 0.4 + 50.5 | 3.2:1 |
| $P_4$ | 421 | 85 + 530 | 0.85 + 50.3 | 1.44:1 |
| $P_5$ | 421.5 | 85 − 520 | 0.85 − 50.2 | 1.32:1 |
| $O_6$ | 422 | 48 − 540 | 0.48 − 50.4 | 2.5:1 |
| $P_7$ | 422.5 | 27 − 534 | 0.27 − 50.34 | 4.2:1 |
| $P_8$ | 423 | 17 − 526 | 0.17 − 50.26 | 6.1:1 |

Table II

NOTCHED ANTENNA INPUT IMPEDANCE CHARACTERISTICS (Two Element Array, equal phase)

| Points | FREQ (MHz) | Zin (ohms) | Zin (ohms) Normalized to 50Ω | VSWR |
|---|---|---|---|---|
| $P_1$ | 419 | 5 + 516.5 | 0.1 + 50.33 | 11:1 |
| $P_2$ | 420 | 10 + 520 | 0.2 + 50.4 | 5.8:1 |
| $P_3$ | 420.5 | 20 + 525 | 0.4 + 50.5 | 3.2:1 |
| $P_4$ | 421 | 42.5 + 515 | 0.85 + 50.3 | 1.44:1 |
| $P_5$ | 421.5 | 42.5 − 510 | 0.85 − 50.2 | 1.32:1 |
| $P_6$ | 422 | 24 − 520 | 0.48 − 50.4 | 2.5:1 |
| $P_7$ | 422.5 | 13.5 − 517 | 0.27 − 50.34 | 4.2:1 |
| $P_8$ | 423 | 8.5 − 513 | 0.17 − 50.26 | 6.1:1 |

Table III

NOTCHED ANTENNA INPUT IMPEDANCE CHARACTERISTICS (Two Element Array, 90° Phase Difference)

| Points | FREQ (MHz) | Zin (ohms) | Zin (ohms) Normalized to 50 Ω | VSWR |
|---|---|---|---|---|
| $P_1$ | 419 | 13.7 + 535.6 | 0.27 + 50.71 | 5.6:1 |
| $P_2$ | 420 | 30 + 540 | 69 0.6 + 50.8 | 3:1 |
| $P_3$ | 420.5 | 57 + 529.8 | 1.14 + 50.59 | 1.7:1 |
| $P_4$ | 421 | 52.6 + 51.9 | 1.05 + 50.04 | 1.05:1 |
| $P_5$ | 421.5 | 50.8 − 51.6 | 1.02 − 50.03 | 1.05:1 |
| $P_6$ | 422 | 51.6 − 518.8 | 1.03 − 50.38 | 1.4:1 |
| $P_7$ | 422.5 | 33.7 − 529 | 0.67 − 50.58 | 2.2:1 |

Table III-continued

NOTCHED ANTENNA INPUT IMPEDANCE CHARACTERISTICS (Two Element Array, 90° Phase Difference)

| Points | FREQ (MHz) | Zin (ohms) | Zin (ohms) Normalized to 50 Ω | VSWR |
|---|---|---|---|---|
| $P_8$ | 423 | 20 − 525.2 | 0.4 − 50.5 | 2.6:1 |

Figure 15:
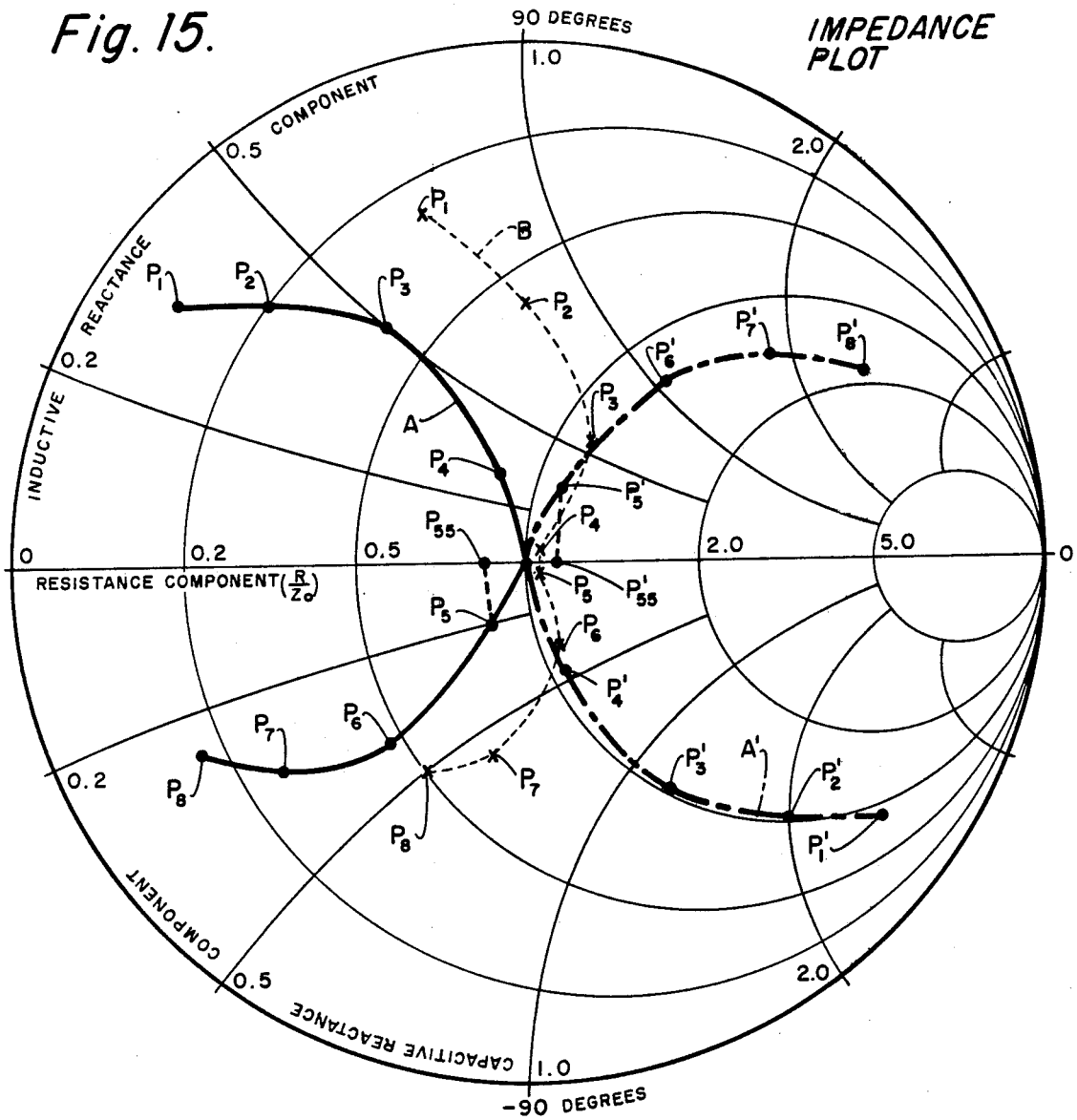
FIG. 15 shows impedance plots for a single typical notch fed electric microstrip antenna element including the inverse thereof, and for a two-element array in parallel but having a 90° phase difference between elements.

In addition to obtaining a wider bandwidth, the 90° phase difference between two elements simplifies matching of the antenna system. This is especially true in elements that have a single tuning capacitor rather than two tuning capacitors. This can be demonstrated by referring to FIG. 15 and recalling from earlier discussion that varying the tuning capacitor not only changes the resonant frequency but also changes the input impedance of the element. In FIG. 15, points $P_1$ through $P_8$ of curve A correspond to points indicated in Table I. Points $P_1'$ through $P_8'$ of curve A' are the inverse of points $P_1$ through $P_8$, respectively. It is desired for the input impedance of the parallel combination of the two elements to be as close to a normalized impedance of 0.5 ohms for optimum match. For the single element situation shown in Table I and plotted in FIG. 15 as curve A, optimum match occurs when the elements normalized input impedance is 1 ohm (zero reactance).

If it is desired to change the resonant frequency of the element, for example, decreasing the capacitance such that Point $P_5$ is resonant, the broken line in FIG. 15 from point $P_5$ to point $P_{55}$, illustrates the change in input impedance. The inverse impedance in curve A' changes in a similar manner from point $P_5'$ to point $P_{55}'$. Although the above illustration gives an over simplification of the change in input impedance, it becomes apparent that when the resonant input impedance of the element deviates from a normalized input impedance of 1 ohm, the parallel combination of a pair of similar elements with a phase difference of 90° gives a better match than would two similar elements with no phase difference. For example, the parallel combination of $P_{55}$ (0.85 ohms) with another $P_{55}$ (0.85 ohms) for the no phase difference condition gives an input impedance of 0.425 ohms. The parallel combination of $P_{55}$ (0.85 ohms) with $P_{55}'$ (1.1 ohms) gives an input impedance of 0.479 ohms. In fact, it is possible to design a two element antenna system such that one may obtain optimum match over a small range of frequencies when tuning a 90° phase difference system. However, in the case of the no phase difference between two elements system, only one optimum capacitor setting exists.

Although the 90° phase difference between the two elements improved the bandwidth and simplified tuning of the antenna system, it also caused a drastic change in the radiation pattern. In the application this antenna is intended for, the change gave an improved radiation pattern. However, it should be noted that the change in the radiation pattern due to the 90° phase difference between the two elements may have a degraded affect in other system applications.

As was mentioned previously, elements 21 in the S-band antenna system, for example, can be phased in quadrature. This is also true for other microstrip antenna elements where a 90° phase difference between each adjacent element or arrays in same antenna system of an antenna assembly is desired. If a 90° phase difference is desired between the elements 21 of the S-band system shown in FIG. 1, for example, one of the microstrip transmission lines connecting feed points 26 of the pair of elements 21 connected to common junction 61 would be made one-quarter wavelength longer than the other, and one of the microstrip transmission lines 25 connecting the other pair of elements 21 to common junction 62 would also be made one-quarter wavelength longer than the other. In addition, one of the microstrip transmission lines connecting junctions 61 and 62 to another common junction 63 near feed point 29 would also be made one-quarter wavelength longer than the other. The use of a one-quarter wavelength section added to a transmission line for providing the phase difference can also be used between a single element and the common junction of a pair or group or other interconnected elements in the same antenna system or array.

The use of a single tuning capacitor 40 in an element, as was discussed above, provides a fairly good tuning range. A single capacitor, however, will not maintain a good impedance match over the whole tuning range of the capacitor. The size of the capacitor used determines the actual tuning range, although not the usable tuning range, in each instance. However, having two capacitors in an element, one at each end, provides a usable input impedance match over the entire tuning range of the capacitors. This in effect more than doubles the tuning range.

Obviously many modifications and variations of the present invention are possible in the light of the above teachings. It is therefore to be understood that within the scope of the appended claims the invention may be practiced otherwise than as specifically described.

What is claimed is:

1. A multiple electric microstrip antenna assembly, comprising:

a. a plurality of different electric microstrip antenna systems operating at different frequencies;

b. each of said microstrip antenna systems comprising at least one thin electrically conducting radiation element; each said radiation element being fed at a single feedpoint and being spaced apart from a thin ground plane conductor by a dielectric substrate;

c. each of said microstrip antenna systems sharing a common thin ground plane conductor and dielectric substrate;

d. at least one of said microstrip antenna systems having a plurality of radiation elements in array with a 90° phase difference between any interconnecting elements and groups of elements sharing a common junction for providing increased bandwidth and ease in tuning;

e. at least one tuning means included within the microstrip antenna substrate beneath each of the elements of at least one of said microstrip antenna systems for fine tuning of the antenna elements and operating to change the resonant frequency, the resonant input impedance and the effective length of said radiating elements;

f. said 90° phase difference being provided between two interconnecting elements sharing a common junction in any of said plurality of microstrip antenna systems by means of the length of a first transmission line between said common junction and the feedpoint to one of said two interconnecting elements being one-quarter wavelength longer than a second transmission line between said common junction and the feedpoint to the other of said two elements; said additional one-quarter wavelength length of said first transmission line operating as an impedance inverter.

2. An antenna assembly as in claim 1 wherein the tuning means within the substrate beneath a radiation element comprises an adjustable capacitor means for fine tuning of the elements at lower frequencies where the bandwidth is usually narrow and to provide compensation for variations in the center frequency of the antenna system caused by variation in the substrate dielectric constant.

3. An antenna assembly as in claim 1 wherein said tuning means within the substrate beneath a radiation element comprises a button type tuning capacitor assembly; a change of capacitance from the element to ground plane affecting the resonant frequency and also the resonant input resistance of the radiation element; and, increasing the capacitance on either end of the radiation element operating to increase the effective length of the element.

4. An antenna assembly as in claim 3 wherein said button type tuning capacitor assembly comprises:

a. a button shaped tuning slug which is adjustably mounted within a cavity in the dielectric substrate directly beneath a portion of the radiation element and between said radiation element and said ground plane conductor;

b. means for moving said button shaped tuning slug between said radiation element and said ground plane conductor, wherein increasing the penetration of said tuning slug within said cavity toward the radiation element increases the capacitance from the radiation element to ground and moving said tuning slug away from the radiation element decreases the capacitance from the element to the ground plane conductor.

5. An antenna assembly as in claim 4 wherein said button type capacitor assembly is located at one end of the radiation element where electric field concentration is higher and thus provides a greater change in capacitance for a smaller penetration of said tuning slug.

6. An antenna assembly as in claim 5 wherein said capacitor assembly is located at any desired point along an end edge of said radiation element.

7. An antenna assembly as in claim 1 wherein two tuning means are located within the substrate one at each end of said radiation element providing a near constant input impedance thereby maintaining a good impedance match over the tuning range and being operable to effectively more than double the usable tuning range provided when only a single tuning means is used.

8. An antenna assembly as in claim 7 wherein the tuning means are an adjustable capacitor means.

9. An antenna assembly as in claim 1 wherein said plurality of microstrip antenna systems operating at different frequencies are closely spaced with minimum coupling by the containment of reactive energy from each individual element between the individual element and the respective ground plane directly beneath each element with minimal fringing effects.

10. An antenna assembly as in claim 1 wherein an etched microstrip shield is provided between the elements of one antenna system and the elements of another antenna system, said shield being of such dimensions as to enhance coupling between the antenna elements of the two antenna systems.

11. An antenna assembly as in claim 1 wherein a 90° phase difference is provided between a first array of at least one element connected to a first junction and a second array of at least one element connected to a second junction by means of one of the transmission lines interconnecting said first junction with said second junction at a common third junction one-quarter wavelength longer than the other; said first and said second array forming at least a portion of the same antenna system.

12. An antenna assembly as in claim 1 wherein said plurality of different microstrip antenna systems comprise at least an S-band antenna system, a C-band antenna system and a UHF-band antenna system arrayed and assembled in close arrangement.

13. An antenna assembly as in claim 12 wherein all the radiation elements of the UHF-band antenna system include said tuning means for fine tuning of the elements.

14. A multiple electric microstrip antenna assembly, comprising: p1 a. a plurality of different microstrip antenna systems operating at different frequencies;

b. each of said microstrip antenna systems comprising at least one thin electrically conducting radiation element spaced apart from a thin ground plane conductor by a dielectric substrate;

c. each of said microstrip antenna systems sharing a common thin ground plane conductor and dielectric substrate;

d. at least one of said microstrip antenna systems having a plurality of radiation elements in array with a 90° phase difference between any interconnecting elements and groups of elements sharing a common junction for providing increased bandwidth and ease in tuning;

e. at least one tuning means included within the microstrip antenna substrate beneath each of the elements of at least one of said microstrip antenna systems for fine tuning of the antenna elements;

f. an etched microstrip shield provided between the elements of at least two different antenna systems; said shield acting as a mode suppressor and allowing very close spacing between elements of the different antenna systems with minimized coupling between antenna systems.

15. An antenna assembly as in claim 14 wherein said shield is grounded to the ground plane.

16. An antenna assembly as in claim 15 wherein the length of said shield is greater than the width of the elements of the antenna system having the greater width elements.

17. An antenna assembly as in claim 14 wherein a 90° phase difference between two interconnecting elements sharing a common junction in any of said plurality of microstrip antenna systems is provided by making the length of the transmission line between the common junction and element feed point to one element one-quarter wavelength longer than the transmission line to the other element; said additional one-quarter wavelength of transmission line operating as an impedance inverter.

18. A tunable microstrip antenna as in claim 14 wherein said tuning means comprises an adjustable capacitor for fine tuning the element to provide compensation for variations in the center frequency.

19. A tunable microstrip antenna as in claim 14 wherein said tuning means comprises a button type tuning capacitor assembly, whereby a change of capacitance from the element to ground affects the resonant frequency and the resonant input resistance of the radiation element, and increasing the capacitance on either end of the radiation element operates to increase the effective length of the element.

20. A tunable microstrip antenna as in claim 14 wherein said button type tuning capacitor comprises:

a. a button shaped tuning slug which is adjustably mounted within a cavity in the dielectric substrate directly beneath a portion of the radiation element and between said radiation element and said ground plane conductor;

b. means for moving said button shaped tuning slug between said radiation element and said ground plane conductor, wherein increasing the penetration of said tuning slug within said cavity toward the radiation element increases the capacitance from the radiation element to ground and moving said tuning slug away from the radiation element decreases the capacitance from the element to the ground plane conductor.

21. A tunable microstrip antenna as in claim 20 wherein said button type capacitor assembly is located at one end of the radiation element where electric field concentration is higher and thus provides a greater change in capacitance for a smaller penetration of said tuning slug.

22. A tunable microstrip antenna as in claim 21 wherein said capacitor assembly is located at any desired point along an end edge of said radiation element.

23. A tunable microstrip antenna as in claim 14 wherein tuning means are located within the substrate at each end of said radiation element providing a near constant input impedance and thereby maintaining a good impedance match over the tuning range; the tuning means at each end of the radiating element being operable to effectively more than double the usable tuning range provided when only a single tuning means is used.

24. A tunable microstrip antenna as in claim 23 wherein the tuning means is an adjustable capacitor means.

* * * * *